US007985327B2

(12) United States Patent
Christensen et al.

(10) Patent No.: US 7,985,327 B2
(45) Date of Patent: Jul. 26, 2011

(54) ELECTRODE, METHOD OF MANUFACTURE AND USE THEREOF

(75) Inventors: Paul Andrew Christensen, Northumberland (GB); Wen Feng Lin, Newcastle-Upon-Tyne (GB)

(73) Assignee: Clarizon Limited, West Lothian (GB)

( * ) Notice: Subject to any disclaimer, the term of this patent is extended or adjusted under 35 U.S.C. 154(b) by 276 days.

(21) Appl. No.: 12/305,292

(22) PCT Filed: Jun. 19, 2007

(86) PCT No.: PCT/GB2007/002299

§ 371 (c)(1), (2), (4) Date: May 12, 2009

(87) PCT Pub. No.: WO2007/148085

PCT Pub. Date: Dec. 27, 2007

(65) Prior Publication Data

US 2010/0065420 A1 Mar. 18, 2010

(30) Foreign Application Priority Data

Jun. 19, 2006 (GB) ..... 0612094.3

(51) Int. Cl.
*C25B 11/06* (2006.01)
*C25B 11/08* (2006.01)
*H01M 4/90* (2006.01)

(52) U.S. Cl. ..... 204/292; 204/291; 204/290.03; 204/252; 204/265; 204/266; 422/186.07; 502/101

(58) Field of Classification Search ..... 205/626, 205/752, 756; 204/290.03, 252, 265, 266, 204/291, 292; 502/101; 422/186.07
See application file for complete search history.

(56) References Cited

U.S. PATENT DOCUMENTS

| | | | | |
|---|---|---|---|---|
| 3,875,043 | A | 4/1975 | Franks et al. | |
| 3,882,002 | A * | 5/1975 | Cook, Jr. | 205/535 |
| 4,040,939 | A * | 8/1977 | Schenker et al. | 204/290.03 |
| 4,233,148 | A * | 11/1980 | Ramsey et al. | 204/291 |
| 4,243,503 | A * | 1/1981 | Lieb et al. | 204/290.01 |
| 4,484,997 | A * | 11/1984 | Secrist et al. | 205/384 |
| 4,614,669 | A * | 9/1986 | Yannopoulos | 438/49 |
| 4,626,334 | A * | 12/1986 | Ohe et al. | 204/290.12 |
| 7,871,740 | B2 * | 1/2011 | Tamura et al. | 429/532 |
| 2004/0176245 | A1 * | 9/2004 | Hagemeyer et al. | 502/337 |
| 2004/0226829 | A1 * | 11/2004 | Cheng et al. | 205/626 |
| 2005/0239643 | A1 * | 10/2005 | Benderly et al. | 502/312 |

FOREIGN PATENT DOCUMENTS

WO 2004/072329 8/2004

OTHER PUBLICATIONS

Wang et al.: "Electrolytic Generation of Ozone on Antimony- and Nickel-Doped Tin Oxide Electrode," J. Electrochem. Soc., vol. 152, No. 11, Sep. 8, 2005, pp. D197-D200, XP002459745.

Beaufils Y et al.: "Use of TI/IR02/SNO2-SB205 Electrodes for Ozone Production," Electrochemical Society Proceedings, Electrochemical Society, Pennington, NJ, vol. 97-28, 1998, pp. 171-186, XP008058582.

* cited by examiner

*Primary Examiner* — Bruce F Bell
(74) *Attorney, Agent, or Firm* — Nixon & Vanderhye, PC

(57) ABSTRACT

An electrode for effective ozone production in an electrochemical cell uses a modified electrode design which adopts a novel catalytic component. The catalytic component has a number of elements selected from various metals and metalloids, and is applied to a substrate in multiple coatings or layers. The catalytic component forms a catalytic surface which is at least partially disrupted by the presence of an element which is relatively inactive with respect to oxygen evolution.

25 Claims, 3 Drawing Sheets

ELECTRODE, METHOD OF MANUFACTURE AND USE THEREOF

This application is the U.S. National Phase of International Application No. PCT/GB2007/002299 filed Jun. 19, 2007, which designated the U.S. and which claims priority to Great Britain Patent Application B 0612094.3, filed Jun. 19, 2006, the entire contents of each of which are hereby incorporated by reference.

TECHNICAL FIELD

This invention relates to production of ozone at a higher efficiency, and hence predictably at a lower cost, than current technologies. The invention to be more particularly described hereinafter involves use of a catalyst in an electrochemical cell.

BACKGROUND ART

The fact that ozone can be manufactured has been known for a long time (c.f. Werner Von Siemens "Ozonizer" circa 1857-1858). The Siemens apparatus operated to produce an electrical discharge as a "corona" or silent discharge. Ozone has been commercially generated in air or oxygen by means of such a corona discharge at a very high voltage ever since then. However, there are concerns that this technology is somewhat inefficient and rather costly in today's market. It has been reported in US2003/209447 A1 that yields in the corona discharge process generally are in the vicinity of 2% ozone, i.e. the exit gas may be about 2% $O_3$ by weight. Obtaining this concentration requires that the input gas is cold and dry and that the system is cooled, typically with large quantities of cold water. The concentration of $O_3$ in the exit gas can be increased by using cold, dry, pure oxygen as the input gas and $O_3$ concentrations in the exit gas of up to 12% have been reported. However, this requires the supply or production of the pure oxygen at extra cost and requiring additional energy. Such $O_3$ concentrations, while quite poor in an absolute sense, are still sufficiently high to furnish usable quantities of $O_3$ for many commercial purposes, which explains why the corona discharge methodology has persisted commercially. Using pure oxygen also overcomes another disadvantage of the corona discharge process, which is that it oxidises any nitrogen in the input gas to produce harmful nitrogen oxides ($NO_x$). Thus, other than the aforementioned electric discharge process, there is no other commercially exploited process for producing large quantities of $O_3$.

Ozone may also be produced by an electrolytic process, wherein an electric current (normally D.C.) is applied across electrodes immersed in an electrolyte. The electrolyte includes water, which in the process dissociates into its respective elemental species, $O_2$ and $H_2$. Under the proper conditions, the oxygen is also evolved as the $O_3$ species. The evolution of $O_3$ may be represented as:

$$3H_2O \rightarrow O_3 + 3H_2;\ \Delta H^0(298\ K) = 868.6\ kJ\ mol^{-1}$$

Therefore, from a commercial standpoint, the known electrolytic process may be viewed as thermodynamically unfavourable in comparison with the established corona discharge process.

Nevertheless, generation of ozone in aqueous media by direct electrolysis is still a technically attractive goal, particularly if dissolved ozone is needed (ozone is poorly soluble in water).

There have been some proposals to develop the evolution of ozone by electrolysis of various electrolytes utilizing very low electrolyte temperatures, but discouragement to commercial exploitation of these proposals is the need to maintain the necessary low temperatures, requiring costly cooling equipment as well as the attendant additional energy cost of operation.

There remain many commercial drivers towards successful exploitation of electrolysis-based ozone production. The efficient, electrochemical generation of ozone is attractive due to the many uses of such a 'clean' and powerful oxidant. Interest in this field increased significantly in the 1980' s, with increased focus on water disinfection and detoxification.

The following patent publications are generally indicative of background art describing prior proposals to utilise electrolytic processes for ozone generation or which produce ozone as a by-product.

U.S. Pat. No. 3,256,164 (Jun. 14, 1966), Donohue, John A., et al. Electrolytic Production of Ozone. In this method of producing ozone, an electric current is passed through a liquid electrolyte, hydrogen fluoride containing not more than 10 weight percent of water, to produce a mixture of gases which contains ozone in large amounts. The procedure is carried out at a temperature of not more than 50° C. but preferably between −20° C. and +20° C. At least one weight percent of water must be present so that the electric current may pass through the liquid hydrogen fluoride and so that oxygen is present which may be converted to ozone. However, hydrofluoric acid is avoided in commercial systems due to the dangers it presents to health.

U.S. Pat. No. 4,316,782 (Feb. 23, 1982) Foller, Peter C., et al. Electrolytic Process for the Production of Ozone, discusses an electrolytic cell for production of ozone with current efficiencies of up to 52%. The cell uses a solution of highly electronegative anions, preferably hexafluoro-anions of phosphorus, arsenic, or silicon. The anode is made of either platinum or lead dioxide, and the cathode is made of platinum, nickel, or carbon. When a direct current is applied using the electrodes, ozone and oxygen are produced at the anode, and hydrogen gas is produced at the cathode.

U.S. Pat. No. 4,375,395 (Mar. 1, 1983) Foller, Peter C., et al. Process for Producing Ozone, describes an electrolytic cell for production of ozone at high current efficiencies which uses glassy carbon electrodes in an electrolytic solution containing highly electronegative $BF_4^-$ or $BF_6^-$ anions. These electrodes are resistant to corrosion by the electrolytic fluorine-anion-containing solution used to produce ozone at the anode. A disadvantage to this method of production of ozone is that glassy carbon electrodes are costly.

U.S. Pat. No. 4,416,747 (Nov. 22, 1983) Menth, Anton, et al. Process for the Synthetic Production of Ozone by Electrolysis and Use Thereof, outlines a process for production of ozone by electrolysis in which the produced ozone is used in water treatment. The anode and cathode are made of stainless steel, and between the anode and cathode is a solid electrolyte made of a plastic polymer based on perfluorinated sulphonic acids. The solid electrolyte serves as a thin ion-exchange membrane which is coated on the cathode side with a layer of a mixture of 85% by weight carbon powder and 15% by weight platinum powder. The anode side of the membrane is coated with $PbO_2$ powder. A solution of oxygen-saturated water is fed into the cell, and ozone is produced in the solution on the anode side of the solid electrolyte ion-exchange membrane while water is formed on the cathode side. The $H^+$ which is produced on the anode side by the decomposition of water to form oxygen and ozone migrates through the ion-exchange membrane and reacts with oxygen in the water on the cathode side to form water. The evolution of hydrogen at the cathode is thereby suppressed.

U.S. Pat. No. 4,541,989 (Sep. 17, 1985) Foller, Peter C. Process and Device for the Generation of Ozone via the Anodic Oxidation of Water describes using an electrolytic cell in which an air cathode reduces the oxygen in air to water, and an inert anode decomposes the water to ozone at claimed levels of ten pounds per day by electrolysis using DC current.

U.S. Pat. No. 5,154,895 (Oct. 13, 1992) Moon, Jae-Duk. Ozone Generator in Liquids suggests an ozone generator consisting of one or more pairs of strip electrodes made of an oxidation resistant metal such as Pt, $PbO_2$, or $SnO_2$ mounted on a substrate inside an ozonizing chamber with outer terminals extending outside the ozonizing chamber. The chamber has an inlet for a liquid such as water or solutions of $H_2SO_4$, $HClO_4$, $HBF_4$, or $H_3PO_4$. An electric current is supplied to the electrodes through the terminals outside the chamber, and water molecules are dissociated at the electrodes producing ozone gas in the liquid without use of the conventional blower to supply carrier air to the ozone generator.

U.S. Pat. No. 5,203,972 (Apr. 20, 1993) Shimamune, Takayuki, et al. Method for Electrolytic Ozone Generation and Apparatus Therefor describes an electrolytic cell wherein the electrolyte separating the anode and cathode is a solid electrolyte, preferably a perfluorocarbon sulfonic acid-based ion-exchange membrane. The anode is made by covering a titanium substrate first with a coat of platinum, gold, or like metal, and then with an electrodeposited layer of lead dioxide. When an electric current is passed through the cell ozone is formed at the anode in an ozone resistant chamber made of Teflon® or titanium.

U.S. Pat. No. 5,332,563 (Jul. 26, 1994) Chang, Shih-Ger. Yellow Phosphorus Process to Convert Toxic Chemicals to Non-Toxic Products outlines a process which involves passing air or oxygen over aqueous emulsions of yellow phosphorus, $P_4$, which results in the formation of $P_4O_{10}$ or $P_2O_5$, and an abundance of reactive species such as atomic oxygen and ozone. This process is a development from the disclosure of U.S. Pat. No. 5,106,601 (Apr. 21, 1992) which outlines a method for removing acid-forming gases such as NO and $NO_2$ from exhaust gases. Ozone is produced in the process. In both cases production of $P_4O_{10}$ or $P_2O_5$ results when the phosphorus combines with oxygen molecules and a large amount of atomic oxygen is detected in area of the reaction. The atomic oxygen may combine with oxygen molecules to form ozone.

U.S. Pat. No. 5,460,705 (Oct. 24, 1995) Murphy, Oliver J., et al. Method and Apparatus for Electrochemical Production of Ozone describes an electrochemical method and apparatus for production of ozone which uses an anode made up of a substrate made from porous titanium, titanium sub-oxides, platinum, tungsten, tantalum, hafnium, niobium, or similar material, and a catalyst coating selected from lead dioxide, platinum-tungsten alloys, glassy carbon or platinum. The cathode is a gas diffusion cathode consisting of a polytetrafluoroethylene-bonded, semi-hydrophobic catalyst layer supported by a hydrophobic gas diffusion layer. The catalyst layer consists of a proton exchange polymer, polytetrafluoroethylene polymer, and a metal such as platinum, palladium, gold, iridium, or nickel. The anode and cathode are separated by an ion-conducting electrolyte which is a proton exchange membrane (PEM) with one side bonded to the catalyst layer of the gas diffusion cathode and a second side touching the anode. An electric current is passed through the anode and the gas diffusion cathode, and ozone is formed at the anode.

An international patent application, WO 2004/072329 (26 Aug. 2004) Cheng, S., et al, Device for and Method of Generating Ozone describes an electrode made from a substrate selected from titanium, gold-coated titanium, and other inert conducting materials, with a coating of tin dioxide modified by antimony. The coating may also include nickel. The coating may comprise particles of from 3 nm to 5 nm in size and in a ratio of Sn:Sb in the range of from about 6:1 to 10:1. Multiple coatings may be applied to the substrate, e.g. by dip-coating and heat treatment steps. The electrode is suitable for direct generation of ozone in water or through water into a gaseous state.

The use of the electrode is described in a cell containing an electrolyte which may comprise $SnCl_4.5H_2O$ and $SbCl_3$ in an ethanol-HCl mixture, or which may simply utilize pure water without any dissolved ions. An optional alternative system comprises a solid polymer electrolyte, such as Nafion®.

Whilst this system represents a significant improvement over previous proposals, there remains room for improvement in certain aspects. In particular, the lifetime of the catalyst in prototype systems developed following this patent has been found to be limited to a few days to weeks at best and the innovations presented in this patent result in even higher efficiencies.

Ozone ($O_3$) is a very strong oxidising agent which has many uses, including those shown in Table 1 below.

TABLE 1

Some applications for generated Ozone

| | | |
|---|---|---|
| Water Treatment | Bottled water and beverages<br>Mains drinking water<br>Water reuse and recycling<br>Contaminant reduction | Taste and odour improvement<br>Pools and spas<br>By-product reduction for chemical disinfection |
| Waste Treatment | Effluent and wastewater treatment<br>Ground water remediation<br>Suspended solids reduction<br>Activated sludges | Soil remediation and treatment<br>Ship ballast water<br>Air conditioning recirculating water<br>Power station cooling water |
| Food Treatment | Disinfection<br>Sterilisation<br>Deodorisation | Preservation<br>Storage<br>Grain treatment |
| Bleaching | Paper<br>Synthetic fibres<br>Teflon | Waxes<br>Flour |
| Decontamination and disinfection | Hospitals | Infectious agent removal |

Chlorine-based products are used for many of these purposes, but they can, in some circumstances, lead to the production of carcinogens such as trihalomethanes and chloramines. Chlorine can be unpleasant to users (e.g. in swimming pools) and can directly contaminate the environment. For example, chlorine-based products are banned from use as a bleaching agent in pulp and paper mills in a number of countries—its use in this field has fallen from 7% to 1% of total chlorine usage in the US. Chlorine plays a major role in the above markets, which consumed around 20% of total chlorine supply in the US in 2002 (12.5M tons at $230 per ton=$2.9 bn).

Ozone is a safe alternative to treatment by chlorine or chlorine-based products. It performs the same functions without the undesirable side effects; it is not harmful to the environment since it rapidly decomposes into oxygen, $O_2$.

The electrochemical generation of ozone depends critically on the proper choice of electrode material and catalyst.

Using conventional anodes, such as Pt, and imposing a sufficiently positive potential on the electrode immersed in aqueous solution will, under normal circumstances, result in the generation of oxygen, according to:

$$2H_2O \rightarrow O_2+4H^++4e^-,\ E°=1.23\ V. \quad (1)$$

Ozone generation relies on suppressing this reaction (e.g. by producing an anode with a "high oxygen overvoltage") such that ozone can then be produced in preference thus:

$$3H_2O \rightarrow O_3+6H^++6e^-,\ E°=1.51\ V,\ \text{and:} \quad (2)$$

$$H_2O+O_2 \rightarrow O_3+2H^++2e^-,\ E°=2.07\ V. \quad (3)$$

An advantage of this strategy is that any loss in current efficiency for ozone generation will mostly lead to the production of harmless oxygen which, in many cases, can actually be useful.

The water oxidation reaction, equation (1), can be suppressed by careful catalyst design and/or through the choice of experimental conditions, both of which directly influence the intermediate species which determine which of steps (1)-(3) above can take place.

A number of anodes have been investigated with respect to furthering research into realising a commercially useful method for electrochemical ozone generation:

Pt, $\alpha$-$PbO_2$, $\beta$-$PbO_2$, Pd, Au, dimensionally stable $RuO_2$ anodes ($RuO_2$DSA), doped diamond, and glassy carbon (GC) in various electrolytes and under a range of experimental conditions. Au, $RuO_2$DSA and GC anodes all yield current efficiencies of <1%.

The state-of-the-art with regard to development of electrochemical technologies is represented by the work of Putnam et al [G. L. Putnam et al, J. Electrochem. Soc., 93 (1948) 211]; Foller and Tobias [P. C. Foller, C. W. Tobias, J. Electrochem. Soc., 129 (1982) 506]; Cheng et al, [WO 2004/072329 A1 (Aug. 26, 2004)] and Murphy and Hitchens [U.S. Pat. No. 5,460,705 (Oct. 24, 1995)].

An object of the present invention is to provide improvements in the production of ozone and in particular to develop an electrochemical process suitable for commercialisation.

DISCLOSURE OF INVENTION

The invention to be more particularly described hereinafter achieves effective ozone production in an electrochemical cell by a modified electrode design which adopts a novel catalytic component. The catalyst suppresses oxygen evolution and promotes ozone production by selection of particular elements which are incorporated in the catalytic component to favourably modify the performance of the catalyst towards the goal of ozone generation. In addition, the innovations dramatically increase the active lifetime of the catalyst. The modified catalyst can be incorporated in an electrode structure, e.g. supported upon a catalyst substrate, carrier element or assembly, of a generally known type but prepared in a unique way according to the invention.

According to a first aspect of the invention there is provided an electrode for use in an electrochemical cell comprising a catalytic component applied to a substrate, the catalytic component comprising a number of elements selected from the group consisting of metals and metalloids, and the catalytic component is applied to the substrate in multiple coatings or layers, and the catalytic component forming a catalytic surface being at least partially disrupted by the presence of an element which is relatively inactive with respect to oxygen evolution in normal use of the electrode.

The electrode preferably comprises multiple coating layers of catalytic component within which there is preferably at least one inter-layer of a composition differing from the other coating layers, e.g. one which comprises Sn:Sb in the ratio 100:10. Such an inter-layer may be electro-deposited.

In particular, the invention offers improvements for ozone production in an electrochemical cell by adopting a dimensionally stable anode which is relatively inactive towards the oxidation of water to $O_2$, and includes at least one additional element which promotes production of ozone.

The anode may comprise Sb-doped $SnO_2$ (or $Sb_2O_5/SnO_2$) together with an additional element selected from the group consisting of metals and/or metalloids that are relatively inactive with respect to oxygen evolution, preferably at least one of Au, Fe, Co, Pb, and optionally including a transition metal. An example of a metal which is not suitable as the primary or sole additional element for the purposes of this invention is Pt due to its activity in oxygen evolution, but it is observed that presence of Pt may offer structural advantages to promote anode useful working life. A suitable ozone-promoting additional element may be selected by comparing its activity in oxygen evolution with Pt, those elements which have significantly less activity with respect to oxygen evolution than Pt being preferred. Therefore, it must be understood that the presence of Pt is not excluded, provided that at least one of the preferred ozone-promoting additional elements is sufficiently included.

The catalyst elements can be selected from the group consisting of Sn, Sb, Fe, Co, Ni, Au, and Pb each in an appropriate state of oxidation.

The catalyst can contain Sn, and other elements are selected from a first group consisting of Sb, and Pt, and also from a second group consisting of Fe, Co, Ni, Au, and Pb.

Preferably the catalyst contains Sn, and at least one other element is Sb, and at least one other element is selected from the group consisting of Fe, Co, Ni, Au, and Pb.

The catalyst can comprise a major proportion of Sn and lesser amounts of Sb, a transition element and Au.

Optionally, the catalyst can comprise a major proportion of Sn and lesser amounts of Sb, a transition element and Pb.

Alternatively, the catalyst can comprise a major proportion of Sn and lesser amounts of Sb, and at least one of the transition elements Fe, Co and Ni.

The catalyst component and other elements can comprise Sn:Sb:Ni:Au, in the approximate atomic/molar ratio 1000:16:2:0.5 to 1000:16:2:20 in an alcohol solution.

The catalyst component and other elements can comprise Sn:Sb:Ni:Au, in the approximate atomic/molar ratio of 1000:16:2:6 to 1000:16:2:4 in an alcohol solution.

The catalyst component and other elements can comprise Sn:Sb:Ni:Au, in the approximate atomic/molar ratio of 1000:16:2:6 in an alcohol solution.

The catalytic component can be applied in layers to the substrate, and at least one inter-layer within the catalytic component can comprise Sn:Sb, in the approximate atomic/molar ratio 100:1 to 100:20.

The catalytic component can be applied in layers to the substrate, and at least one inter-layer within the catalytic component can comprise Sn:Sb, in the approximate atomic/molar ratio 100:10. Furthermore, the interlayer can be electro-deposited.

According to a second aspect of the present invention there is provided an electrochemical cell comprising a first electrode including a catalyst, the catalyst composed of an antimony-doped tin composition including at least one of the following elements Au, Pb, Fe, Co, and Ni, a counter electrode, first and second chambers for receiving electrolyte and/or water, said chambers being divided by a separator or membrane, and a casing for the cell, at least part of which casing is adapted to collect gases.

Optionally the first electrode forms the anode located in a first chamber in the cell, and the first chamber contains an electrolyte in contact with the anode which comprises an acid and/or water, and the counter electrode forms the cathode in a second chamber in the cell, and the electrolyte in contact with the cathode comprises an acid and/or water.

The anode and cathode can both be in close contact with the two sides of a proton exchange membrane (forming a membrane electrode assembly), and, in this case, air or oxygen can be in contact with the cathode, as alternatives to an acid and/or water.

According to a third aspect of the present invention there is provided a catalytic component for use in an electrochemical cell for ozone production comprising a substrate upon which a catalyst is supported, the catalyst consisting of an antimony-doped tin composition containing at least one additional element selected from Au, Pb, Fe, Ni, and Co.

The catalyst can be applied in multiple layers, at least one of which layers may have a composition differing from the other layers.

A surface layer of the catalyst may present Au as an element embedded in the surface.

Alternatively, a surface layer of the catalyst presents Pb as an element embedded in the surface.

A surface layer of the catalyst may present Fe as an element embedded in the surface.

Alternatively a surface layer of the catalyst may present Co as an element embedded in the surface.

Preferably at least one layer comprising tin catalyst and antimony, which is substantially free of any other active element, is included as an interlayer in the catalytic coating.

Optionally substantially all of the catalytic layers include Ni.

The catalyst applied to the substrate may be derived from a coating solution in which the atomic/mole ratio of the elements tin:antimony:nickel:gold is 1000:16:2:6.

At least one layer comprising tin and antimony can be derived from a coating solution in which the atomic/mole ratio of the elements tin:antimony is 100:10.

MODES FOR CARRYING OUT THE INVENTION

The following reactions at the anode of this invention are contemplated:

$$3H_2O \rightarrow 6H^+ + 6e^- + O_3 \quad (1)$$

Or, more efficiently:

$$O_2 + H_2O \rightarrow O_3 + 2H^+ + 2e^- \quad (2)$$

A conventional structure for the electrode may be adopted e.g. forming a carrier substrate for the doped catalytic electrode surface. A titanium mesh may be suitable for this purpose, but another inert material, even a ceramic, may be useful as the core for the active surface of the electrode. It will be understood that the functional catalytic layer of doped surface material may be applied as multiple coating layers or depositions to provide a suitable coverage over the carrier substrate, e.g. 20 such layers or depositions may offer a commercially durable anode. A minimum or maximum level is not specified but a sufficient amount must be applied to provide a functional anode coating over the carrier substrate, and this can be readily determined by simple trial experimentation with the materials.

The type of catalyst which is currently considered suitable for performance of the invention is one such as that described in WO 2004/072329, which teaches an anode electrocatalyst (based on an empirical composition Ni:Sb:Sn 1:8:500, requiring connected nanoparticles with a size [diameter] distribution in the range 3-5 nm) has, to date resulted in (for a limited period) a current efficiency for ozone generation of over 36% at room temperature, corresponding to 34 mg $L^{-1}$ of dissolved ozone. This is the highest current efficiency that the inventor's are aware of for the electrocatalytic generation of ozone in an aqueous medium at room temperature. Initially, upon start-up, ozone generation efficiency can be in excess of 80%, but after a period of use this level typically falls to from 30% to 35%. Such catalysts are, however, found to fail after a period of operation and it is an objective of this invention to overcome such failure.

Such a catalyst is surface modified to achieve the benefits obtainable by the invention to be more fully described herein. Valuable modification include use of Au or Pb as additional surface elements to promote ozone production whilst avoiding enhanced oxygen production, and inclusion of an interlayer within the catalyst layers to improve operational life and performance. Typically, the surface of the modified catalyst is smoother than the unmodified catalyst, with particle sizes in the range of 5 nm to 20 nm.

Typically, an apparatus for producing ozone will comprise a multi-compartment electrochemical cell, the compartments defining at least a cathode chamber and an anode chamber, said chambers being divided by at least one separator, and each including an electrode, wherein at least one chamber receives an electrode of the aforementioned type according to the invention.

The apparatus may comprise a membrane divided cell. In such a cell the anodic chamber(s) and the cathodic chamber (s) are divided by a membrane which may be a proton-exchange membrane (PEM), and the electrodes are positioned in an operational functional position close to, but usually not in contact with the separator/membrane. Specifically, if the electrolyte is acidic then the electrodes and membrane need not be in contact. However, if the electrolyte is water then the closer the electrodes are to the membrane the better, due to resistance. Finally, when the electrolyte is air or oxygen then the electrodes and membrane must be in contact.

In an embodiment of the invention, a series of chambers is arranged in a "battery" of cells wherein alternating chambers include an electrode for generating ozone, or an electrode for generating hydrogen. Appropriate ducting is provided with separators to direct evolved gases to collectors.

The anode and cathode chambers may be divided one from the other by a membrane assembly comprising a proton exchange membrane in close contact with catalytic material (for example, on the surface of an electrode, embedded in a paste electrode or suspended in a carbon granular electrode), and arranged within the chambers to contact fluids introduced to the cell chambers in use. The proton exchange membrane is not permeable to gas. A fluid and gas permeable material is preferably arranged to overlie the catalytic coating. The fluid and gas permeable material may be a porous metal.

The cell may comprise a casing adapted to snap-fit around the separator assembly and incorporate fluid seals therebetween. Alternatively, corresponding casing parts may be presented about the separator assembly, suitable seals to avoid fluid-leakage are introduced, and the casing parts closed using fastening means, e.g. rivets, adhesive, welds, or threaded fasteners. The fastening means may compress the seals, which may be custom gaskets or O-rings depending upon the configuration of the casing parts. Obviously, the person skilled in the art will understand that care should be taken to select materials resistant to ozone for the chamber housing the anode where ozone is to be generated. Proprietary materials such as the fluorinated polymers VITON®, KYNAR and TEFLON®, may be useful for surfaces liable to contact ozone, and NYLON fasteners may be suitable with such materials.

In the method according to the invention, a cell analogous to that of the typical fuel cell design is adapted to generate ozone electrochemically by passing a current through a particular membrane assembly, by means of electrodes arranged on either side of the membrane, the electrodes respectively being in contact with an electrolyte or water, and air, oxygen, water, or an electrolyte. Ozone and oxygen are generated around the electrode in contact with the electrolyte/water and protons pass through the membrane. The protons combine to form hydrogen at the second electrode if it is in contact with an electrolyte or water, or to form water if it is in contact with oxygen or air. Use of a particular catalyst in the membrane assembly allows superior performance over that anticipated for other electrochemical methods of producing ozone.

BRIEF DESCRIPTION OF DRAWINGS

The invention will now be described by way of illustrative example with reference to the accompanying drawings, in which.

EXAMPLE

Figure 1:
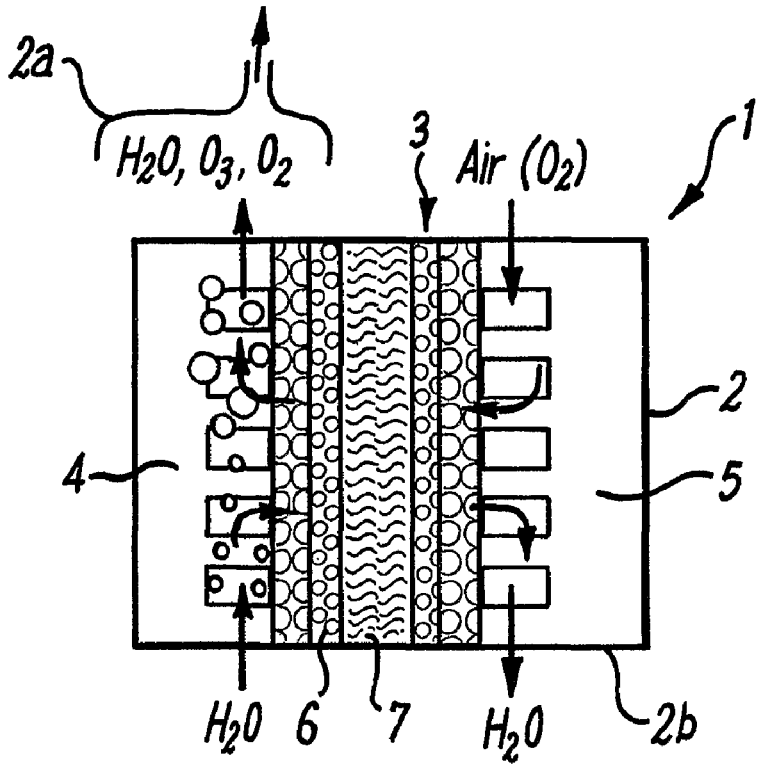
FIG. 1 is a schematic sectional view through an electrochemical cell suitable for performance of the invention.
Figure 2:
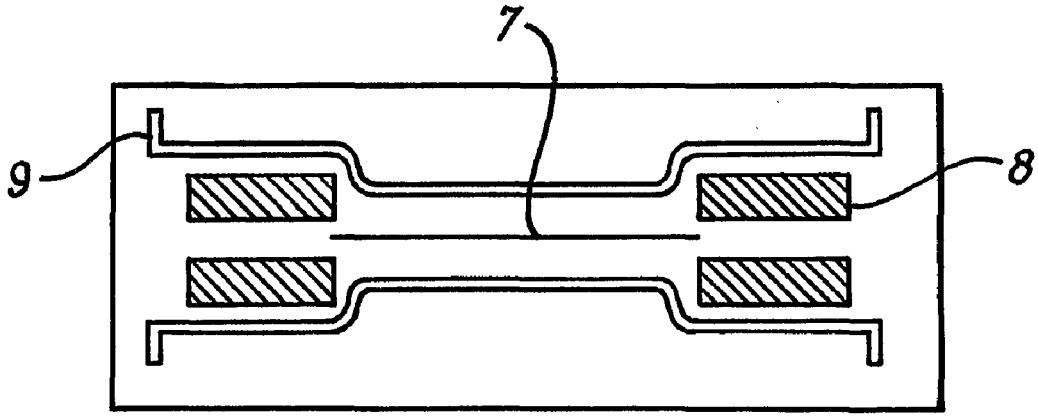
FIG. 2 is a schematic sectional view of an embodiment of electrode plate design.

In an embodiment of the invention, a catalytic component is prepared for use in an electrode, using a titanium mesh substrate cleaned with oxalic acid. An intermediate electrodeposited (ED) coating of Sn:Sb (100:10) in an alcohol solution is applied to form an ED interlayer. Catalytic coatings are then applied sequentially to gradually build up a stable coating, each coating being heat treated at 500° C. to 600° C. Perhaps 20 or so coatings are needed depending upon the technique applied. The composition of the coatings is based upon Sn:Sb:Ni:Au in an approximate atomic/mole ratio of between 1000:16:2:0.5 to 1000:16:2:20 in an alcohol solution. The composition of the coatings can be based upon Sn:Sb:Ni:Au in an approximate atomic/mole ratio of 1000:16:2:6 to 1000:16:2:4 in an alcohol solution. The composition of the coatings is advantageously based upon Sn:Sb:Ni:Au in an approximate atomic/mole ratio of 1000:16:2:6 in an alcohol solution. The elements are each in an appropriate oxidation state.

Finishing of the coated substrate to render it suitable for use as an electrode is carried out using conventional techniques using for example conductive connectors e.g. titanium wire and or conductive plate. This forms the basis for a dimensionally stable anode (DSA).

A production cell 1 for producing ozone using the DSA comprises inert walls 2 and a base 2*b* defining a container for electrolyte and configured to receive a separator 3 to define therein a plurality of chambers 4, 5, alternate ones of which receive the DSA 6. The cell is covered by a manifold 2*a* adapted to collect and convey gases away from the cell. The manifold has provision for attachment of electrical connections (not shown). Cells may be connected in parallel within a common casing. The materials chosen are ozone resistant e.g. fluorocarbon based structural and sealing components. Fluid connections (not shown) for adding electrolyte, water, etc. are provided. The connections provide for flow-through to facilitate a continuous or extended batch run process.

The separator is an assembly of components including a proton-exchange membrane (PEM) &, and gaskets 8 for sealing and spacing purposes. Provision is made for completing the assembly with conductive plate components 9. Configuration of the plates is such as to partially envelope the PEM to assist with positioning and assembly. The PEM and associated gaskets act as the electrical insulator between the conductive plate components which serve as electrodes.

The assembled cell may be oriented in any position, and connected to fluids supply.

Figure 3:
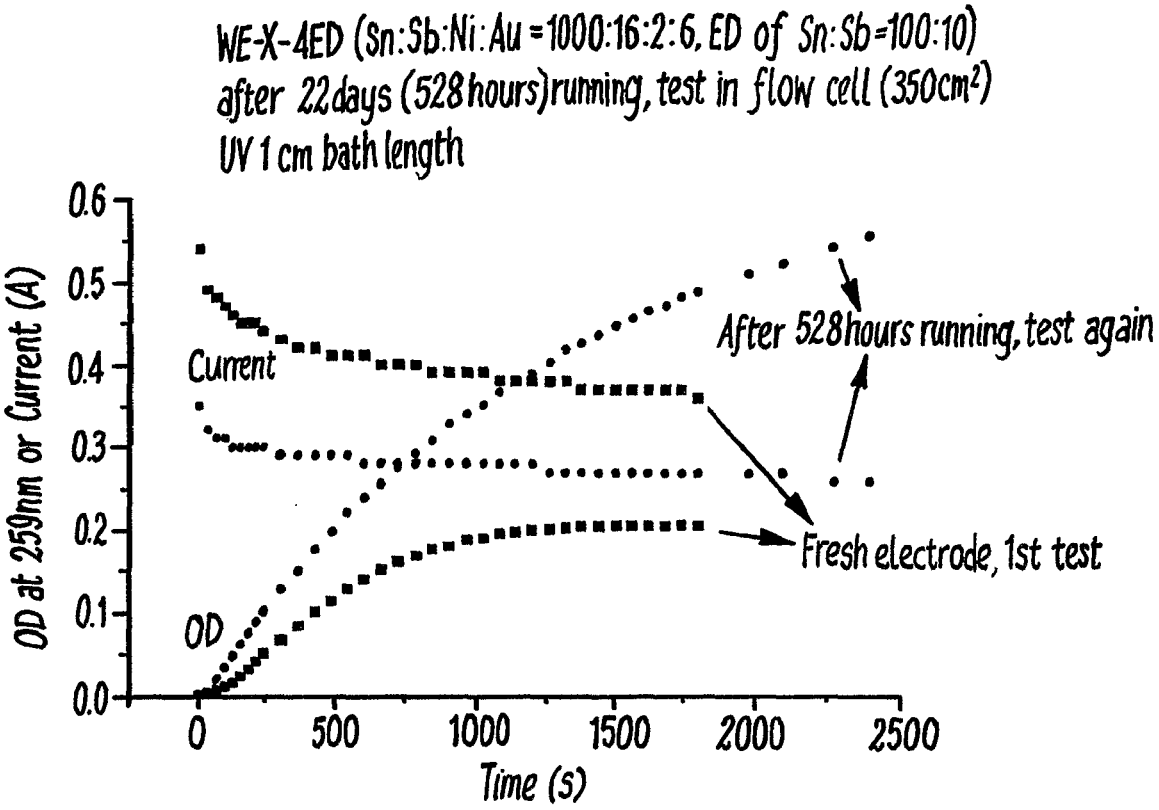
FIG. 3 is a graph illustrating performance of a test embodiment of the invention in terms of current efficiency and absorbance.

In use of the cell, a nominal voltage of 2.7 V is applied for a chosen time period, and evolved gases ($O_3$ and $H_2$) are collected separately. During one test (40 days) current and absorbance (OD) were monitored. The current was maintained above 0.09 A. FIG. 3 is representative of the results of the test.

Figure 4:
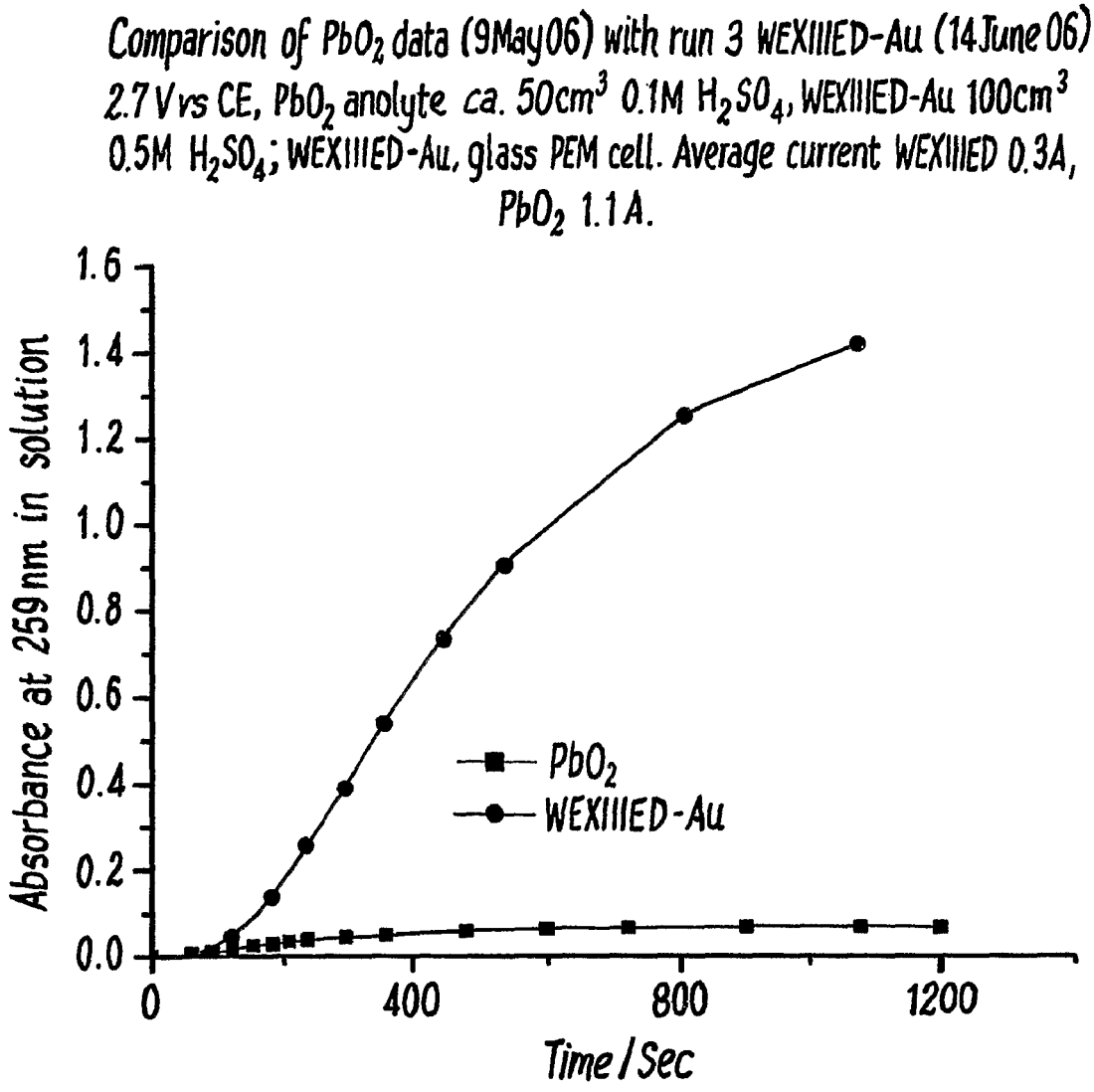
FIG. 4 is a graph that compares the solution phase ozone generated by a commercial $PbO_2$ cell with that generated by an Au doped anode electrode of the present invention in a glass PEM cell.

Illustrated in FIG. 4 is a graph that compares data for ozone production by a standard lead dioxide ($PbO_2$) electrode and by an electrode according to the present invention (WEXIIIED-Au), both operating at 2.7V and in the same conditions. It is clear from FIG. 4 that the electrode of the present invention acts to generate a greater volume of ozone over a shorter timescale than electrodes known to the art. In particular, FIG. 4 illustrates that the electrode of the present invention will advantageously produce ozone at a significantly lower current than that necessary for electrodes of the prior art (0.3 A for the present invention versus 1.1 A for $PbO_2$). Therefore if, for example, the $PbO_2$ electrode is operating at a typical current efficiency of 1-10%, then the electrodes of the present invention are clearly vastly superior to those known to the art.

In addition to the data provided in FIG. 4, the outcome of a range of tests (not reported here) suggests that the catalyst, electrode, and cell made available by the invention described herein represent a significant step forward in electrolytic methods of ozone production.

INDUSTRIAL APPLICABILITY

The invention finds utility in a wide range of fields, including potable water management, food production, waste treatment, hygiene and health care, raw material processing, and environment management.

Improvements and modifications may be incorporated herein without deviating from the scope of the invention.

The invention claimed is:

1. An electrode for use in an electrochemical cell, said electrode comprising a catalytic component applied to a substrate, the catalytic component being applied to the substrate in multiple coatings or layers, and the catalytic component comprising Sb, Sn, a transition element, and at least one of Au and Pb, and the catalytic component forming a catalytic surface being at least partially disrupted by the presence of at least one of Au and Pb.

2. An electrode as claimed in claim 1 wherein the multiple coating layers of catalytic component comprise at least one inter-layer of a composition differing from the other coating layers.

3. An electrode as claimed in claim 1, wherein at least one inter-layer within the catalytic component comprises Sn:Sb, in the atomic ratio 100:1 to 100:20.

4. An electrode as claimed in claim 3 wherein at least one inter-layer within the catalytic component comprises Sn:Sb, in the atomic ratio 100:10.

5. An electrode as claimed in claim 1, wherein an inter-layer is electro-deposited.

6. An electrode as claimed in claim 1, wherein the electrode comprises Sb-doped $SnO_2$.

7. An electrode as claimed in claim 1, wherein the electrode comprises $Sb_2O_5$ and $SnO_2$.

8. An electrode as claimed in claim 1, wherein the catalytic component comprises a major proportion of Sn and lesser amounts of Sb, a transition element and Au.

9. An electrode as claimed in claim 1, wherein the catalytic component comprises a major proportion of Sn and lesser amounts of Sb, and at least one of the transition elements Fe, Co and Ni.

10. An electrode as claimed in claim 1, wherein the catalytic component and other elements comprises Sn:Sb:Ni:Au, in the atomic ratio 1000:16:2:0.5 to 1000:16:2:20.

11. An electrode as claimed in claim 10, wherein the catalytic component and other elements are applied in a coating solution.

12. An electrode as claimed in claim 11 where the coating solution is an alcohol solution.

13. An electrode as claimed in claim 1, wherein the catalytic component and other elements comprises Sn:Sb:Ni:Au, in the atomic ratio of 1000:16:2:6 to 1000:16:2:4.

14. An electrode as claimed in claim 1, wherein the catalytic component and other elements comprises Sn:Sb:Ni:Au, in the atomic ratio of 1000:16:2:6.

15. An electrochemical cell comprising a first electrode including a catalyst, the catalyst composed of an antimony-doped tin composition including a transition element and at least one of Au and Pb, a counter electrode, first and second chambers for receiving electrolyte and/or water, said chambers being divided by a separator or membrane, and a casing for the cell, at least part of which casing is adapted to collect gases.

16. An electrochemical cell as claimed in claim 15 wherein the first electrode forms the anode located in a first chamber in the cell, and the first chamber contains an electrolyte in contact with the anode which comprises an acid and/or water, and the counter electrode forms the cathode in a second chamber in the cell, and the electrolyte in contact with the cathode comprises an acid and/or water.

17. An electrochemical cell as claimed in claim 16 wherein the electrode is an anode.

18. A catalytic component for use in an electrochemical cell for ozone production comprising a substrate upon which a catalyst is supported, the catalyst consisting of an antimony-doped tin composition containing a transition element and at least one additional element selected from Au and Pb.

19. A catalytic component as claimed in claim 18 wherein the catalyst is applied in multiple layers, at least one of which layers has a composition differing from the other layers.

20. A catalytic component as claimed in claim 19 wherein the differing layer comprises tin and antimony, is substantially free of any other active element, and is included as an inter-layer in the catalytic coating.

21. A catalytic component as claimed in claim 19, wherein substantially all of the catalytic layers include Ni.

22. A catalytic component as claimed in claim 19, wherein at least one layer comprising tin and antimony is derived from a coating solution in which the atomic ratio of the elements tin: antimony is 100:10.

23. A catalytic component as claimed in claim 18, wherein a surface layer of the catalyst presents Au as an element embedded in the surface.

24. A catalytic component as claimed in claim 18, wherein a surface layer of the catalyst presents Pb as an element embedded in the surface.

25. A catalytic component as claimed in claim 18, wherein the catalyst is derived from a coating solution in which the atomic ratio of the elements tin: antimony: nickel: gold is 1000:16:2:6.

* * * * *